US012644374B2

(12) United States Patent
Williams et al.

(10) Patent No.: US 12,644,374 B2
(45) Date of Patent: Jun. 2, 2026

(54) METHODS OF SWABBING LIQUID LOADED WELLS, AND KILLING WELLS, WITH THE USE OF COMPRESSION PUMPS, REGULATORS AND FILTRATION TECHNIQUES

(71) Applicant: ZENRG Services, LLC, Houston, TX (US)

(72) Inventors: Ronald Williams, Kingwood, TX (US); Sam Edwards, Sugar Land, TX (US); Joe Chandler, Houston, TX (US); Cameron Brasier, Spring, TX (US)

(73) Assignee: ZENRG Services, LLC, Houston, TX (US)

( * ) Notice: Subject to any disclaimer, the term of this patent is extended or adjusted under 35 U.S.C. 154(b) by 109 days.

(21) Appl. No.: 18/628,790

(22) Filed: Apr. 7, 2024

(65) Prior Publication Data

US 2025/0314166 A1 Oct. 9, 2025

Related U.S. Application Data

(60) Provisional application No. 63/456,516, filed on Apr. 2, 2023, provisional application No. 63/456,528, filed on Apr. 2, 2023.

(51) Int. Cl.

| | |
|---|---|
| ***E21B 47/06*** | (2012.01) |
| ***E21B 21/00*** | (2006.01) |
| ***E21B 21/06*** | (2006.01) |
| ***E21B 21/08*** | (2006.01) |
| ***E21B 27/00*** | (2006.01) |
| ***E21B 43/12*** | (2006.01) |
| ***E21B 43/34*** | (2006.01) |

(52) U.S. Cl.

CPC ..... *E21B 47/06* (2013.01); *E21B 43/12* (2013.01); *E21B 43/122* (2013.01); *E21B 21/002* (2013.01); *E21B 21/062* (2013.01); *E21B 21/065* (2013.01); *E21B 21/082* (2020.05); *E21B 27/005* (2013.01); *E21B 43/123* (2013.01); *E21B 43/34* (2013.01); *E21B 43/35* (2020.05)

(58) Field of Classification Search

CPC combination set(s) only.
See application file for complete search history.

(56) References Cited

U.S. PATENT DOCUMENTS

| | | | | |
|---|---|---|---|---|
| 11,550,974 | B2 * | 1/2023 | Samson | G01V 20/00 |
| 2009/0236144 | A1 * | 9/2009 | Todd | E21B 33/0355 175/5 |
| 2011/0180262 | A1 * | 7/2011 | O'Dowd | C10G 1/06 166/303 |

(Continued)

*Primary Examiner* — Binh Q Tran
(74) *Attorney, Agent, or Firm* — Mintz, Levin, Cohn, Ferris, Glovsky and Popeo, P.C.

(57) ABSTRACT

A method to unload a fluid mixture from an underground production tubing, in order to reduce the hydrostatic pressure within the fluid mixture. A method to kill an oil or gas well by equalizing pressure between the production tubing, the casing annulus, and a surface tank battery, by depressurizing the fluid within the production tubing and the casing annulus, and by pumping a kill fluid. One goal of the methods may be to avoid discharging unwanted liquid phase or gas phase to the atmosphere, therefore reducing unnecessary emissions, and valuing the recovered products.

13 Claims, 7 Drawing Sheets

(56) References Cited

U.S. PATENT DOCUMENTS

| | | | | |
|---|---|---|---|---|
| 2011/0214920 | A1* | 9/2011 | Vail, III | E21B 17/18 175/371 |
| 2016/0024904 | A1* | 1/2016 | Zupanick | E21B 43/305 166/50 |
| 2022/0010647 | A1* | 1/2022 | Clunie | E21B 41/0007 |
| 2023/0356813 | A1* | 11/2023 | Hutchinson | B63B 25/08 |

* cited by examiner

METHODS OF SWABBING LIQUID LOADED WELLS, AND KILLING WELLS, WITH THE USE OF COMPRESSION PUMPS, REGULATORS AND FILTRATION TECHNIQUES

BACKGROUND

The field of use involves using techniques to unload an oil and gas well that has been liquid loaded and unable to produce due to a hydrostatic fluid column that may be preventing the normal flow of a well from its producing horizon.

Most wells, particularly gas wells, may have liquid loading which may occur at some point during the productive life of the well. This may occur when wells lose the production velocities necessary to carry liquid, like produced water, oil or condensate, to the surface. The well loses energy as the hydrostatic head created by the accumulated liquids counters the reservoir's natural pressure or wells that still have high bottom hole pressure can become liquid loaded due to other causes (increase in surface pressure, loss of injection gas, etc. . . . ). Gas flow becomes intermittent, lowering the production rate, and eventually stops if liquid loading is not addressed.

Several methods may be used to remove accumulated liquids and restore regular gas flow including: (1) Shutting in the well to allow bottom hold pressure to increase, (2) Mechanical swabbing the well to remove accumulated fluids, (3) Installing artificial lift system, (4) Installing velocity tubing, (5) Reducing wellhead/flowline pressure by venting the well to atmosphere, a process known as well blowdown.

Venting the well to atmospheric pressure, a process known as a well blowdown, will usually remove fluids from the wellbore and reestablish gas flow, however, this process results in gas losses and increased emissions of methane to the atmosphere and must be repeated as liquids reaccumulate in the well. Plunger lift is one of artificial lift methods that may be utilized as an established techniques for removing liquids from aging gas wells while minimizing gas losses and methane emissions. Gas lift may be also another technique that can be used for artificial lift mechanism to increase production; gas is injected into a produced wells casing annulus to help lift liquids up to the surface through the production tubing at one of several injection ports strategically placed at various stages vertically down the tubing string. Combining both plunger lift and gas lift, known as Gas Assisted Plunger Lift (GAPL), may be another common application of artificial lift used to help reduce liquid loading of production wells.

The proposed invention would specifically address liquid unloading as a replacement to conventional mechanical swabbing techniques to solve liquid unloading of wells that are on plunger lift, and liquid unloading and "kicking off" or re-starting wells on gas lift.

Mechanical swabbing is one of the current methods that may be used to remove liquids from a well that is restricting production. A mechanical swabbing rig is used to remove the fluids from the well that are preventing the producing zones to flow due to the excessive hydrostatic head of the fluid column that is restricting the flow from the producing formation. These swabbing rigs may normally have a winch with a cable and a foldable mast with a pulley system that is lowered into the wells with swab cups designed to lift and remove liquid from a well. Each trip into the well may result in the removal of a given volume of liquid, up to as many as 6 barrels [1 cubic meter] per trip; some wells may take just one trip while other may require multiple trips to remove the desired amount of fluid to get the well flowing again. As the well ages, the frequency of swabbing may increase. In addition to the high costs of this process to the operator, the gas removed from the well during the swabbing process if often vented to atmosphere, resulting in undesirable methane emissions, and the mechanical process of swabbing poses risk of getting stuck or presenting other mechanical downhole risks to the well.

Plunger lift can be used as an artificial lift technique in a gas well or an oil well, and the mechanics of those plunger lift systems are the same. A plunger or piston, which can incorporate a bypass valve, travels through the production tubing to the bottom of the well where it lands on a bottomhole bumper spring. The plunger has enough clearance to allow it to move unhindered up and down the tubing string with a clearance small enough to create a mechanical seal between the fluids above and below the plunger. The up and down movement of the plunger not only controls gas production from the well but also scrapes any initial appearances of paraffin and scale deposits from the wellbore walls and lifts them to the surface. Typically, plunger lift operation is a cyclical process of shut-in (or no-flow) and flow periods. The cycle begins in the shut-in mode with the plunger resting on the bottomhole bumper spring at the base of the well. The surface valve is in the closed position, which allows well pressure to build as gas accumulates in the annular space between the casing and the tubing. When the pressure reaches a preset level, the controller opens the surface valve. Tubing pressure quickly drops to line pressure, allowing pressurized gas from the annulus to enter the tubing below the plunger. The gas pushes the plunger and the fluid column above it to the surface. The fluids above the plunger flow through an upper and lower outlet on the wellhead and into the flowline. The plunger stops in a spring-loaded receiver in the lubricator. When the plunger is no longer in the flow path, the gas that supplied the lifting energy flows through the lower outlet into the flowline. The gas flow rate and pressure at the wellhead will begin to drop as produced gas flows out of the well, causing wellbore liquids to start falling back down and accumulating in the wellbore. Once the pressure drops below a preset level, the automatic controller closes the surface valve and releases the plunger, which falls back down to the bottomhole bumper spring. The cycle begins again as liquid loads above the plunger and annular gas pressure builds. Controlling the plunger travel speed and cycle times is critical to safety and efficiency.

In some cases, gas lift wells may be converted to plunger lift. The tubing strings may be anchored or isolated with a packer assembly. In either case, when the gas lift well is converted to a plunger lift well, it becomes known as a GAPL. The GAPL wells typically rely on having some level of compression in the field available to occasionally inject field gas into the well to aid with unloading the well if a plunger becomes lodged at the base of the well on the bumper spring and has too much hydrostatic head that prevents it from going thought its cycle. Some wells on compression may have a dedicated compressor per well or may rely on a central compressor station to feed field gas to the wells in need of injection. This may help revive liquid loaded plunger lift wells. Some of the events that can occur that will cause a plunger to liquid load include, but not limited to, having a temporary increase in sales line pressure, losing power to the facility, loss of injection support gas, or an issue due to wearing of the plunger or other mechanical restriction such as sand or paraffin. In either case, having to keep and maintain permanent installations of field compressor units is costly and ineffective as the time required to bring the plunger wells back online and cycling is typically between 1 and 3 days.

Plunger lift wells that were not formerly on gas lift may suffer from the same problem as GAPL wells with liquid load due to a wide variety of issues occurring in the field with power surges, compressor station outages, and other common events that disrupt the normal plunger cycle and cause liquid loading to occur. In this case, after plunger lift stops cycling and the reservoir flow stops, and all liquids accumulate above the plunger, at the bottom of the tubing. A common approach to temporarily restore flow is to vent the well to the atmosphere, or to "blowdown" the well which produces substantial methane emissions. This may be becoming increasingly more difficult due to increasing regulations, which are more restrictive in some states then others.

The field of use may also include the draw-down, de-pressurization, and killing of any well in any geologic basin regardless of its geographical location, shut-in or flowing pressures, pressures, gas/oil ration, or production type for oil and gas wells in the upstream sector. The procedure to "kill" a well may be required on every well prior to removing the wellhead when a workover operation needs to be performed on a well. Typical wells may contain and intentionally produce methane gas, condensate, oil, water, and unintentionally produce byproducts such as formation solids and a variety of other non-commercial products in various states such as other gases, liquids, scale, or paraffin. Therefore, the wells typically contain a mixture of liquid, gas, and solids and any state of intermediate phases thereof. The pressures encountered at the wellhead at the onset of the draw-down or de-pressurization process can vary widely and is highly dependent on well depth, the formation pressures, fluid density and column height, and fluid phases within the production casing or tubing, but in all cases, it is greater than 0 psi [0 MPa]. Well heads may now be designed to handle pressures up to 20,000 psi [138 MPa], yet chokes and manifold designs are typically included as part of the field gathering infrastructure to ensure the fluids being delivered for sales is regulated down to pressures typically lower than 1,000 psi [6.9 MPa]. This may be done to ensure the production separators, batteries and other infrastructure can safely and effectively process, store and route production further downstream for sales and refining.

Additionally, in the wellbore, there may be one or more casing or tubing annuli with pressure on them during shut-in. The pressures on these may be different or the same, depending on the completion type and whether there is connectivity between each of the annuli due to an isolation packer being in place or other potential wellbore restrictions causing the differences. The pressures from each of the annuli are always available for monitoring at the wellhead via a pressure gauge. When the wells are shut in prior to blowdown, each of the respective pressures are referred to as a shut-in pressures; there is a shut-in tubing pressure and a shut-in casing annulus pressure. These pressures are often higher than the flowline, separator, or tank battery pressures where the well is tied in to for routing production to a sales line.

Wells may need to be drawn-down or de-pressurized for various reasons but typically it is to perform a workover operation or re-completion, including routine well maintenance for issues like running tubing into a well (tube-ups), tubing repair, rod repair, Electrical Submersible Pump replacements, valve replacement, re-entry drilling, recompletions, casing repair, or a variety of other well clean-out operations to remove paraffins, debris or other solids in the well that may be impeding production. Wells may also need to be drawn-down and de-pressurized as part of the Plug and Abandon process. In order to access a well to perform any of the workover, recompletion services, or Plug and Abandon, the initial step of the process is to remove the wellhead after the draw-down, de-pressurization, and killing process to gain direct access to enter the wellbore. To remove the wellhead, there must be a sufficient overbalance condition in the well to ensure the well is killed and therefore will not flow when the wellhead is removed. Once the wellhead is removed, a blowout preventer (BOP) may typically be flanged up to the casing head to serve as a pressure safety barrier during the intervention procedure, after which case the wellhead is replaced and the well is brought back on production.

A typical existing method used to perform the well draw-down de-pressurization, and well killing operation may be using one of many types of transportable open top containers as a vessel to capture everything flowing from the well including liquids, gases, and solids. The liquids and solids flow from the well and are captured in an open top container and the free gas is either vented into the atmosphere via a device referred to as a gas buster or in some cases a flare stack may be used to burn the free gas flowing back from the well. There may be multiple scenarios to draw-down, de-pressurize, and kill the well based on the well completions configuration. If the well is being produced without tubing in the well, then there will only be one pressurized casing annulus volume to be drawn-down, de-pressurized, and killed. If the well has tubing inside of the casing as part of the completion design and is isolated in the casing with a packer assembly or any other isolation device, then the wellhead may have a tubing pressure of "x" and a casing annulus pressure of "y" to be drawn-down, de-pressurized, and killed. In such case where there is an isolated tubing string pressure and casing annulus pressure, the draw-down, de-pressurization, and well kill process will always be performed sequentially by accessing the appropriate wing valves on the wellhead associated with each respective annuli section to gain access to the pressured volume; typically, the tubing is de-pressurized first followed by the casing annulus. The shut-in wellhead tubing and/or casing annulus pressures on a well can be anywhere from 0 psi [0 MPa] or greater. If the casing annulus is isolated from the tubing string often the shut in pressures are different. In the case of a gas lift completion, the casing annulus may have a significantly highly shut in pressure, set at a pressure equal to or near the gas injection pressure used on the well to activate the gas lift valves. Regardless of how many unique tubing and casing annuli exists, once the pressure is sufficiently low, a "kill" fluid is often pumped into the annuli to a level sufficient to create an overbalance condition with a hydrostatic head to ensure the well will no longer flow. The fluid may be a weighted kill fluid, or simply fresh water or brine water.

When using the transportable open-top container method, all the product produced from the well are wasted and can potentially present environmental pollution hazards, including methane emissions or CO2 emissions from flaring, cleanup cost of the tank, waste product traceability and extensive recordkeeping. After the liquid phase is captured in the open top container it is ultimately disposed of by emptying the contents into a vacuum truck and the gas phase would either be vented into the atmosphere or burned using a designated flare. Using the current method, the produced hydrocarbon product inside the well is wasted along with lost revenue from production in addition to associated carbon taxes and other potential regulatory related penalties.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Even if advantages and other features will become apparent from the following schematics, description and proposed claims, the proposed list of advantages may be limiting.

The proposed invention process may use a combination of some elements of the methods described in the existing art section, while adding specific usage, features and control method.

One advantage of the proposed invention may eliminate the need to have dedicated compression at each facility to unload plunger lift wells whether it would be a standalone conventional plunger lift well or a GAPL, or may eliminate the need for utilizing a mechanical swabbing unit. The process may take on several variations and dependent of the well type, pressure conditions, field gas availability, and other conditions of the well.

In the case where the well is a standard plunger lift well, a single cross-compression pump may be used to pull fluid (liquids & gas) out of the tubing and re-inject into the flowline to reduce the hydrostatic head to allow the well to begin flowing and reset the plunger to its routine cycle. This process can be accomplished by either pulling fluids directly off the wellhead at the wing valve connection or on the back side of the separator if the well has a dedicated separator it is tied to.

In the case where the well is a GAPL, a portable gas compression unit can be used to inject field gas into the casing annulus while simultaneously pulling liquids out of the tubing using a second cross-compression unit.

In the event something is lodged in the well that may be preventing the plunger to lift, the cross-compression pump can be used to pump water or kill fluid into the well to verify there is no obstruction or to attempt to remove any obstruction that may be in place due to sand, paraffin or other materials.

The following item numbers refer to the FIGS. 1 to 7, which are depicting the proposed invention.

Figure 1:
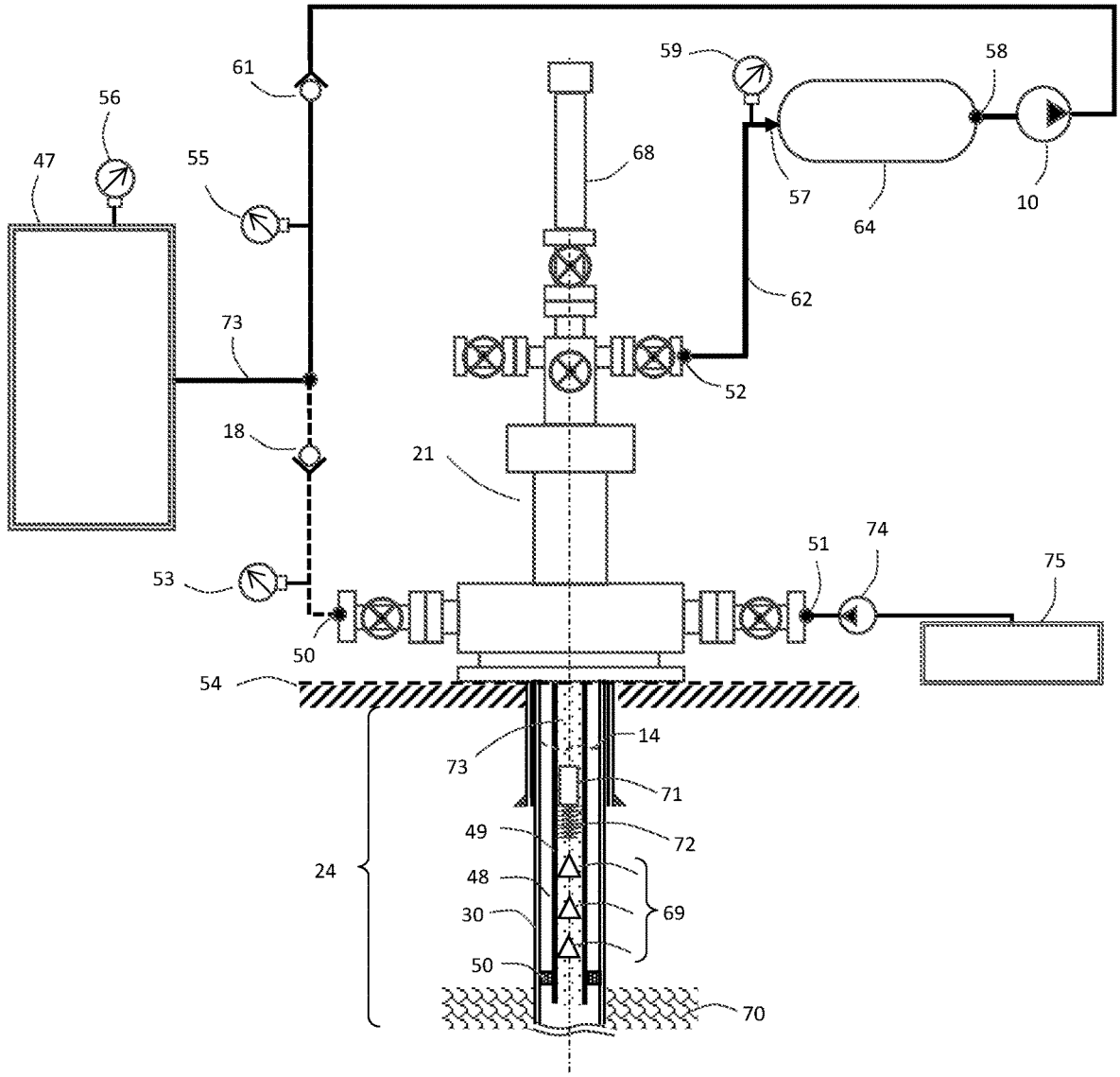
FIG. 1 represents a schematic of the components and connections related to the proposed invention in order to unload the liquid column from the production tubing.

As depicted in FIG. 1, the proposed invention includes a separation vessel 64 inline between a tubing connection valve 52, linked to a well head 21 of an underground well 24, and a surface tank battery 47, linked to a flow line 73. The separation vessel 64 may also be considered as a filter vessel.

The underground well 24 may have various shapes. As represented in FIG. 1 as a non-limiting example, the underground well 24 may include a vertical section. The underground well 24 may also include horizontal or deviated sections.

The underground well 24 may include an underground production tubing 49. Around the underground production tubing 49, a casing 30 may be placed. Typically, the casing 30 may be cemented and linked with the well head 21, above the surface 54.

The underground well 24 may be the producer of gas or oil. The underground well 24 may be filled with a fluid mixture 73, including a liquid and solids phase as well as a gas phase. Depending on the composition fluid mixture 73 and other parameters like the geographical region, geological parameters, depth, the pressure inside the underground well 24 may vary. Possibly a delimitation between the liquid phase and gas phase may be present within the fluid mixture 73. The delimitation may be represented as a virtual line 14 in FIG. 1.

The casing 30 may include a volume 48 between the internal surface of the casing 30 and the external surface of the underground production tubing 49. The volume 48 may be considered as casing annulus. The bottom of the casing annulus may be closed by a packer 50.

The casing 30 may be in contact with a formation 70, which may include a liquid phase or gas phase to be recovered for value. The formation 70 may be linked with the casing 30 through perforations, toe valves, production valves.

The delimitation line 14 may delimit a zone with a liquid column, which is restricting the formation 70 from flowing, because the hydrostatic pressure may be higher that the pressure of the formation 70. Therefore the delimitation line 14 may be considered as an hydrostatic fluid column 14.

Within the underground production tubing 49, artificial lift equipment may be positioned to support the production of the fluid mixture 73 present within the underground production tubing 49. As possible artificial lift equipment, as represented in FIG. 1, multiple gas lift valves 69 may be used to help displacing the gas phase. In addition, a plunger 71 may be used as a piston to help lifting the fluid mixture 73 to surface 54. The plunger 71 may include a lift spring 72.

The separation vessel 64 may allow the tank battery 47 and associated flow line 73 to only receive free gas or liquids from a vessel end connection 58, typically located at an outlet end 58 of the separation unit 64.

As depicted in FIG. 1, a compression pump 10 may be used to remove the fluid from the underground production tubing 49, to lighten the hydrostatic pressure so that production can be re-established.

There should be sufficient tubing pressure that can be "blown-down" by using the compression pump 10 as a means of evacuating the underground production tubing 49 without venting the contents of the tubing to atmosphere, ultimately allowing the gas phase and the liquid phase present in fluid mixture 73 to flow from the underground well 24 towards the well head 21 and passing through the tubing connection valve 52. After passing through the well head 21, the fluid mixture may flow through the separator vessel 64, thanks to the compression pump 10. A flowline 62 may link the tubing connection valve 52 to the entry valve 57 of the separation vessel 64. A pressure gauge or sensor 59 may be present at the entry of the separation vessel 64. The discharge of the separation vessel 64 may be represented with a discharge valve 58, linking to the suction of the compression pump 10 and further connection to the flow line 73. The flowline 73 may link to the surface battery tank 47. The surface battery tank 47 may be considered as a recovery tank for both a gas phase and liquid phase, with one potential goal to recover and value the pumped fluid mixture within the surface battery tank 47. A pressure gauge or sensor 55 may be present along the flow line 73. A check-valve or anti-return valve 61 may be present between the output of the compression pump 10 and the surface battery tank 47, in order to have only a one-way flow of fluid mixture from the compression pump 10 towards the surface battery tank 47.

The flowing pressures during the described pumping process may be below the maximum pressure of the surface tank battery 47, in order to prevent any relief valves from opening and to maintain flow to sufficiently evacuate the underground production tubing 49. Pumping may continue long enough to ensure the hydrostatic fluid column 14 is sufficiently lowered to allow production to resume. In the event the well is on plunger lift with plunger 71, the pumping process may conclude once the plunger 71 is lifted to the surface and lands in the lubricator 68, at the top of the well head 21. Depending on the effectiveness of the liquid unloading, this process may need to be repeated multiple time to ensure the plunger is operating at its required cycle.

Possibly, as depicted in FIG. 1, the compression pump 10 may be used to remove the fluid from the underground production tubing 49 and a secondary compression pump 74 may be used to pump field gas from a gas source 75, to lighten the hydrostatic pressure so that production can be re-established.

In this scenario, the pressure of the underground production tubing, typically measured at the gauge or sensor 59, may be too low for the compression pump 10 and may be insufficient to remove the gas phase and the liquid phase from the well because the pressure within the formation 70 is too low. The secondary compression pump 74 may be connected to the casing annulus through a valve 51. The field gas from the gas source 75 may be injected either into a gas lift valve 69 or into other perforation in the base of the underground production tubing 49. The field gas may also be pumped to create a u-tubing flow around the bottom of the underground production tubing 49 in the event there is no packer 50 in place and the underground production tubing 49 is simply anchored in place with no pressure isolation between the underground production tubing 49 and the casing annulus 48. Injecting field gas may be done to help lighten the load within the underground production tubing 49 by creating gas bubbles within the liquid column to assist liquid movement to the surface. Simultaneously, "blowing-down" the underground production tubing 49 using the compression pump 10 as a means of evacuating the underground production tubing 49 without venting the contents of the tubing to atmosphere, ultimately allowing the hydrostatic fluid column 14 to flow from the underground well 24 towards the tubing connection valve 52 into the separation vessel 64.

Possibly, as depicted in FIG. 1, a connection line through a valve 50 of the well head 21 may connect the casing annulus 48 to the surface battery tank 47. The valve 50 may typically be kept closed in regular operation as described previously. A pressure gauge or sensor 53 as well as a check-valve 18 may be present on the connection line linking the casing annulus 48 to the surface battery tank 47.

Possibly the single compression pump 10, as represented in FIG. 1 may be a group of compression pumps or units 10.

The separation vessel 64, also designated as knock-out tank, or gas buster, or slug catcher, or trap tank, filter unit, may have the shape of a barrel or tank, either in a vertical position or horizontal position. The separation vessel 64 may be used to separate the fluid mixture 73 being pulled from the underground production tubing 49, into a solid phase, a liquid phase and a gas phase.

The compression pump 10, as well as the secondary compression pump 74, may be operated manually, remotely, or automated. The compression pumps 10 and 74 may function through pneumatic, pressure, electrical, mechanical, or other hydraulic means. The type of compression pumps 10 and 74 may include a piston pump, a screw pump, a diaphragm pump, a centrifugal pump, a gear pump, a lobe pump, a metering pump, a progressive cavity pump, a plunger pump or multi-phase pump.

Figure 2:
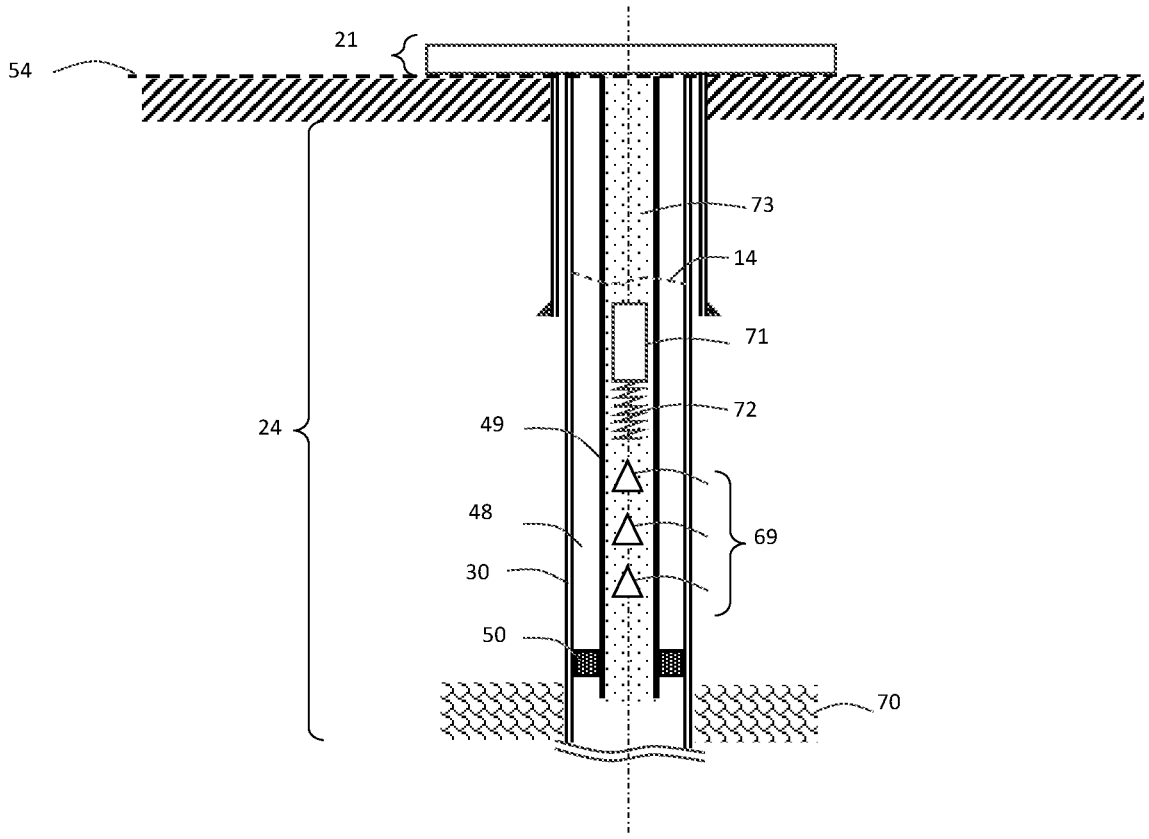
FIG. 2 represents a detailed view of FIG. 1, focusing on the underground well, with plunger and gas lift valve.

FIG. 2 depicts a detailed section of the underground well 24. Items have been described within FIG. 1.

Figure 3:
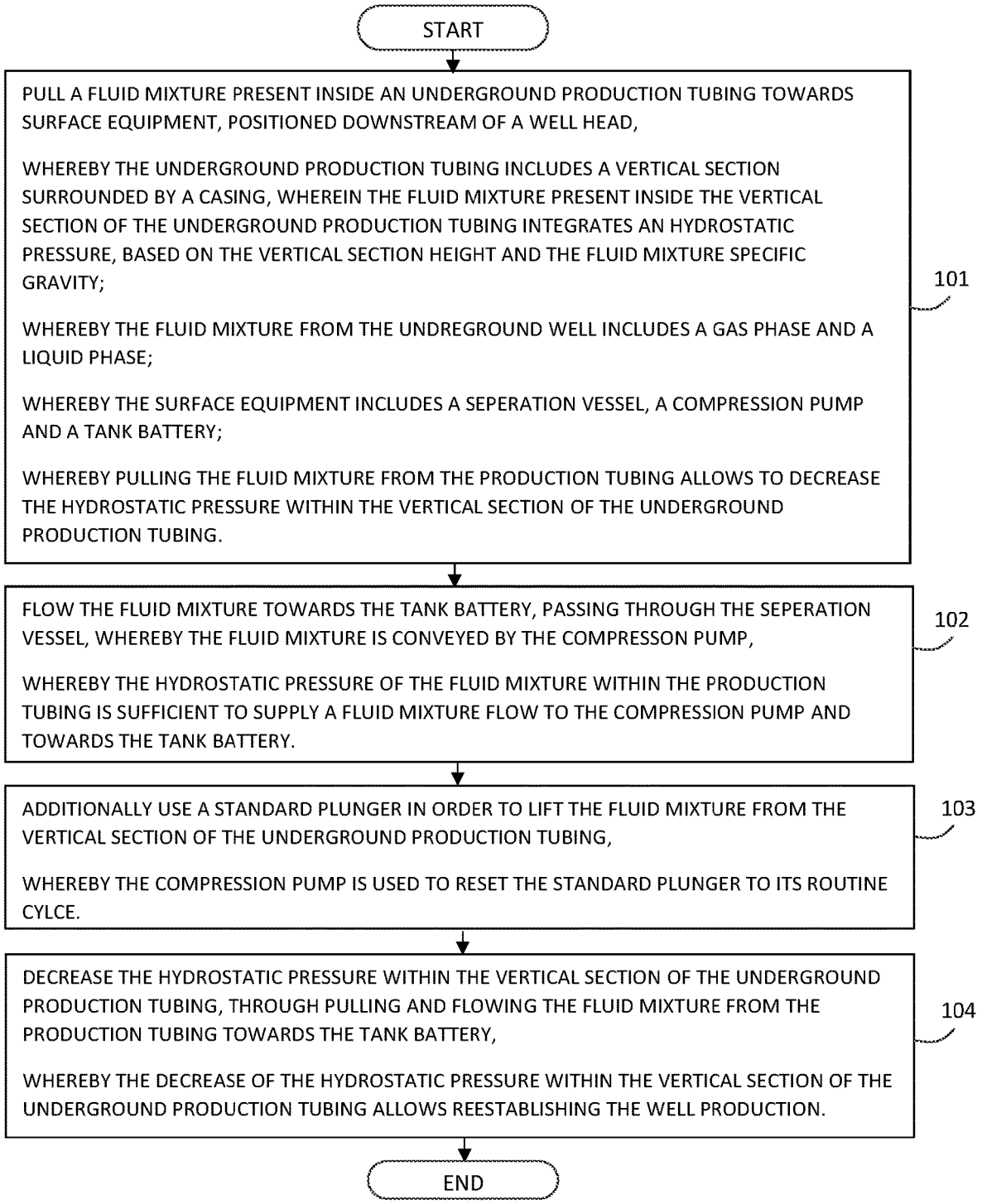
FIG. 3 represents a detailed method flowchart including the major steps of the invention linked to FIG. 1.

FIG. 3 depicts a flowchart sequence method, related to the flow schematic described in FIG. 1 and FIG. 2.

A first step 101, with starting the sequence method, includes pulling the fluid mixture 73, present inside an underground production tubing 49, towards surface equipment, positioned downstream of a well head 21. The underground production tubing 49 includes a vertical section surrounded by a casing 30, wherein the fluid mixture 73 present inside the vertical section of the underground production tubing 49 integrates an hydrostatic pressure, based on the vertical section height and the fluid mixture specific gravity. The fluid mixture 73 from the underground well 24 includes a gas phase and liquid phase. Note that a solid phase may also be present as a bi-product of the well completions and production. The surface equipment includes a separation vessel 64, a compression pump 10 and a surface tank battery 47. Pulling the fluid mixture 73 form the underground production tubing 49 allows decreasing the hydrostatic pressure within the vertical section of the underground production tubing 49, and may allow re-establishing the well production with liquid and gas phase flow from the formation 70.

In step 102, the fluid mixture 73 is flown towards the surface tank battery 47, passing through the separation vessel 64, whereby the fluid mixture is conveyed by the compression pump 10. The hydrostatic pressure of the fluid mixture 73 with the underground production tubing 49 may be sufficient to supply the flow of the fluid mixture 73 to the compression pump 10 and towards the surface tank battery 47.

In step 103, which may be considered as an additional or not required step, the plunger 71 is used to lift the fluid mixture 73 from the vertical section of the underground production tubing 49. The compression pump 10 may be used to reset the plunger 71 to its routine cycle.

In step 104, the hydrostatic pressure within the vertical section of the underground production tubing 49 may be decreased through the pulling and flowing of the fluid mixture 73 from the underground production tubing 49 towards the surface tank battery 47. The decrease of the hydrostatic pressure within the vertical section of the underground production tubing 49 would allow re-establishing the well production, with a gas or liquid phase flowing from the formation 70 towards the surface equipment.

Steps 101, 102, 103 and 104 may occur simultaneously or sequentially.

Figure 4:
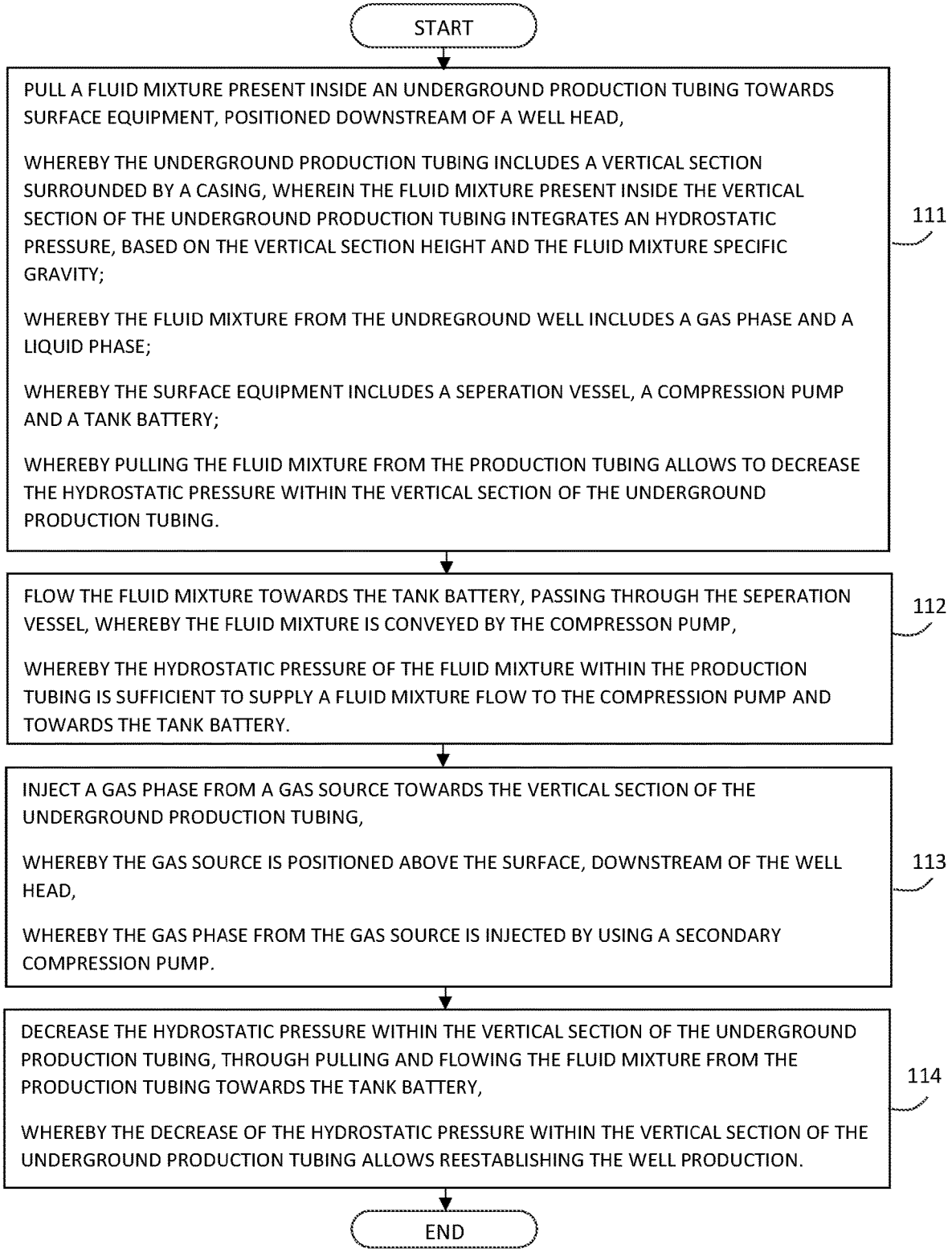
FIG. 4 represents another detailed method flowchart including the major steps of the invention linked to FIG. 1.

FIG. 4 represents an alternate flowchart sequence method compared to FIG. 3. FIG. 4 is related to FIG. 1 and FIG. 2, specially referring to the pumping of the field gas from the gas source 75 towards the casing annulus 48 of the underground well 24, passing through the secondary compression pump 74.

Step 101 and 111 would be similar and the same description may be used. Step 102 and 112 may be similar and the same description may be used. Step 104 and 114 may be similar and the same description may be used.

In step 113, a field gas phase may be injected from a gas source 75, towards the vertical section of the underground production tubing 49. The gas source 75 may be a tank or reservoir holding the field gas, located downstream of the well head 21. The field gas may be injected using the secondary compression pump 74.

Figure 5:
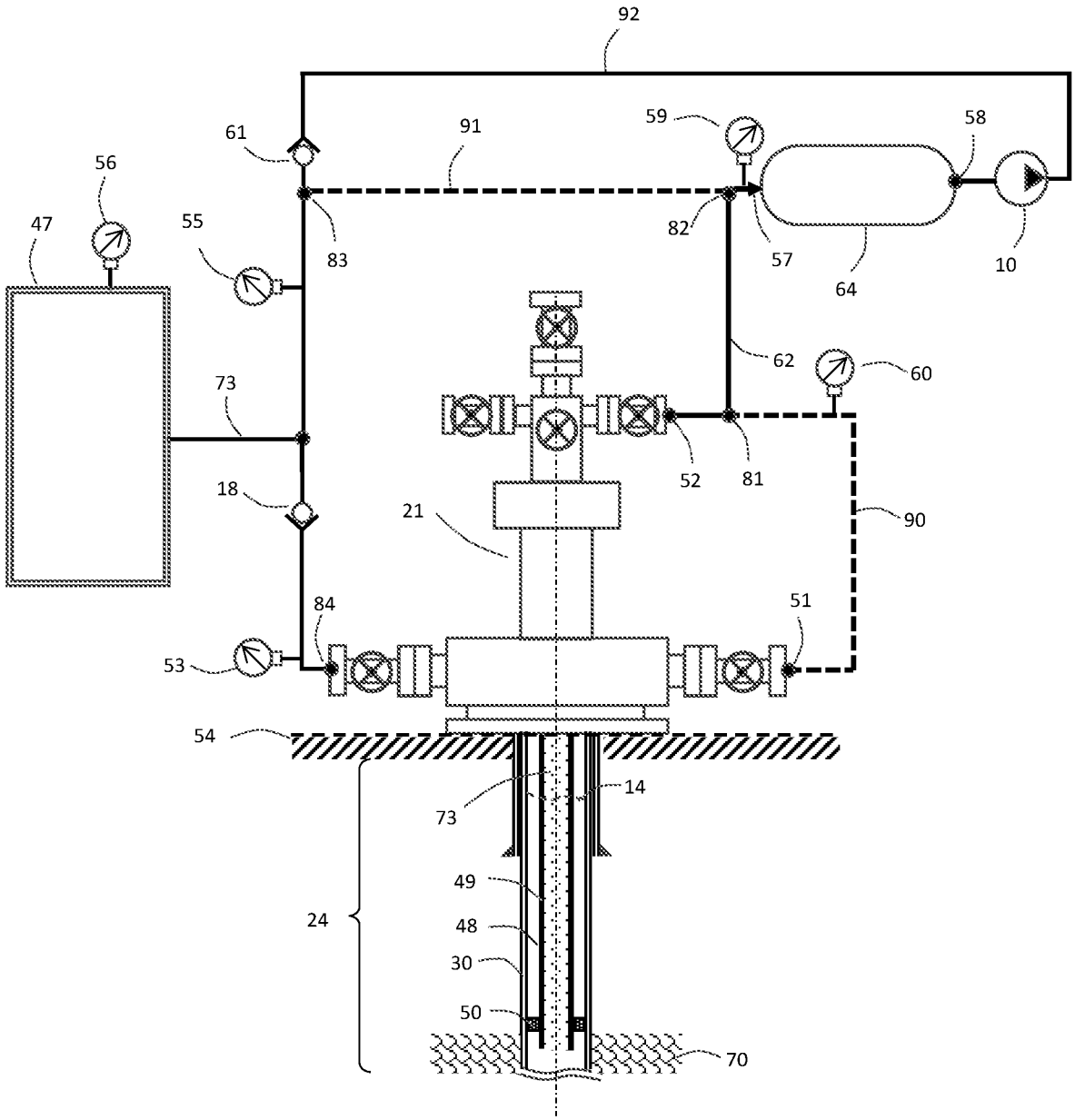
FIG. 5 represents a schematic of the components and connections related to the proposed invention in order to equalize pressures between underground well and surface equipment.

FIG. 5 represents the components and equipment needed to equalize the fluid pressure between the underground production tubing 49 and the casing annulus 48, in order to kill the underground well24 at the end of the process.

As depicted in FIG. 1, the underground well 24 depicted in FIG. 5 may be similar. The underground well 24 may be an oil or gas producing well. The shape of the underground well 24 depicted is vertical, though the underground well 24 may include a deviated or horizontal section. More than one underground production tubing 49 may be present, such as re-frac liners or secondary tubing. As depicted, the underground well 24 may include a casing 30, an underground production tubing 49, a packer or multiple packers 50. The casing annulus 48 may be defined similar as for FIG. 1. The formation 70 may be located towards the end of the underground production tubing 49, though could be spread out along the length of the casing 30 or the length of the underground production tubing 49. The casing 30 and the underground production tubing 49 may have the shape of steel pipes that may extend the full length of the underground well 24, or cover a subsegment of the total well depth, ranging in lengths from hundreds of feet [100 meters] in depth to tens of thousands of feet in depth [3000 to 8000 meters]. These sections may be below the ground level 54 and their orientation can run from a wholly vertical wellbore to any angle up to and exceeding 90 degrees, otherwise known as horizontal wells. The diameter of the tubing may typically be smaller in size compared to the casing 30, and used specifically for producing fluids from the target formations to the surface and typically is over 2 inches [50 mm] and under 4 inches [100 mm], and a first casing 30 which may contain the underground production tubing 49 may typically be over 5 inches [127 mm] and under 9⅝ inches [244 mm]. the underground production tubing 49 and the casing annulus 48 may be filled with the fluid mixture 73, including a liquid phase, a gas phase and a solids phase, that may be dependent on the fluid types in the formation, the mechanical integrity and type of formation, and whether there are any residual chemical artifacts that may result from degradation or scaling of the tubing or casing, and precipitates from the formation such as paraffins or salts. Some of the gas may be free gas, and other liquid fractionations may exists depending on the gas oil ratio, formation pressures, temperatures, and other chemicals constituents of the formation fluid. There may or not be a packer 50, that is set at some depth in the well that isolates the casing annulus 48 from the underground production tubing 49, or the tubing may be hung off in the casing annulus 48, so there may be continuous communication between the pressure of the casing annulus 48, with the pressure of the underground production tubing 49. A pressure gauge or sensor 60 may monitor the pressure of the casing annulus 48, if the fluid present in the casing annulus 48 is connected to the well head 21 through a casing annulus connection valve 51. A pressure gauge or sensor 59 may monitor the pressure of the underground production tubing 49, if the fluid present in the the underground production tubing 49 is connected to the well head 21 through a tubing connection valve 52.

In some cases, the underground production tubing 49 may include gas lift valves set at various stages along the length of the production tubing strategically in place for wells that are on "gas lift" for completions, as depicted in FIG. 1 and FIG. 2. Other wells may have Electrical Submersible Pumps landed at the bottom of the production tubing to aid lifting the producing fluids to surface, and some wells at later stages of their life may be on rod lift for aiding production. Regardless of the completion type, at some stage of a well's life, they will all need to have an intervention performed on them and the drawdown/de-pressurization process must first be performed before the wellhead 21 can be removed to gain access to the underground production tubing 49 and the casing annulus 48. A well may also have a liquid/gas interface 14 that delineates free gas section of the wellbore from the liquid section of the wellbore. The height of the liquid/gas interface 14 may vary and depends largely on whether the well is producing liquids, whether it be hydrocarbons or formation water, and the formation pressure.

FIG. 5 may display a first step of the kill well procedure. The first step may include the pressure equalization between the casing annulus 48 and the underground production tubing 49, with the surface tank battery 47. The tubing connection valve 52 and the casing annulus connection valve 51 may be open, while connecting the fluid coming out of both valves 51 and 52 with a flow line 90, in order to equalize the pressure. The pressure may be further equalized by connecting the tubing connection valve 52 to the surface battery tank 47 through a flow line 91. As depicted in FIG. 5, additional valves 81, 82 and 83 may need to be adjusted in order to have a fluid communication between the fluid present within the underground production tubing 49 and the surface tank battery 47. Pressure monitored by different pressure gauges and sensors may display or read similar pressure values, namely the pressure gauge 56 on the surface battery tank 47, with the pressure gauge 55 and the pressure gauge 60.

FIG. 5 may display the second step of the kill well procedure. The second step includes the drawdown and de-pressurization of the underground production tubing 49 and of the casing annulus 48.

A compression pump 10 may be used to pull fluid firstly through the casing annulus connection valve 51 and pumping the fluid towards the surface battery tank 47. In order to pass the fluid from the casing annulus 48 towards the surface battery tank 47, passing through the compression pump 10 and a separation vessel 64, the casing annulus connection valve 51 would need to be open, the fluid may be connected through the flow line 90, then pass through the valve 81, which may be a 3-way valve, then pass through the valve 82, which may be a 3-way valve, enter the separation vessel 64 through an inlet valve 57, exit the separation vessel 64 through an outlet valve 58, pass through the compression pump 10, continue through the flow line 92, pass through the check-valve 61, pass through the valve 83, which may be a 3-way valve, continue through the flow line 73 which connects to the surface tank battery 47. Pumping of the fluid present within the casing anulus 48 may continue up to the pressure within the surface tank battery has reached a value between 5 psi and 20 psi [0.03 MPa and 0.14 MPa].

The compression pump 10 may the used to pull fluid secondly through the tubing connection valve 52 and pumping the fluid towards the surface battery tank 47. In order to pass the fluid from the underground production tubing 49 towards the surface battery tank 47, passing through the compression pump 10 and the separation vessel 64, the tubing connection valve 52 would need to be open, the fluid may be connected through the flow line 62, while passing through the valve 81 and passing through the valve 82, then enter the separation vessel 64 through the inlet valve 57, exit the separation vessel 64 through the outlet valve 58, pass through the compression pump 10, continue through the flow line 92, pass through the check-valve 61, pass through the valve 83, continue through the flow line 73 which connects to the surface tank battery 47. Pumping of the fluid present within underground production tubing 49 may continue up to the pressure within the surface tank battery has reached a value between 5 psi and 20 psi [0.03 MPa and 0.14 MPa].

Figure 6:
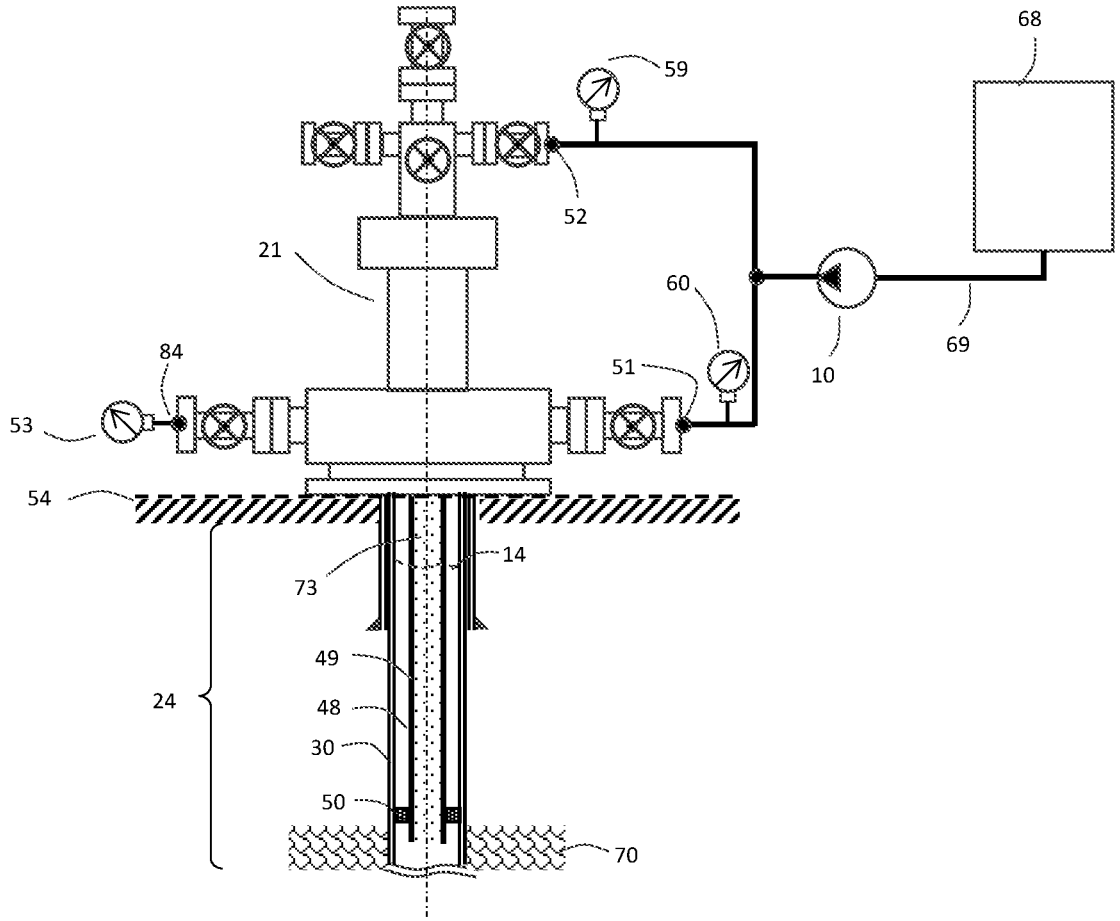
FIG. 6 represents a schematic of the components and connections related to the proposed invention in order to kill a well with pumping surface water.

FIG. 6 displays the third and last step of the proposed kill well procedure. In this step, as displayed in FIG. 6, a water reservoir 68 may be connected to the compression pump 10. The compression pump 10 may be the same pump or a different one compared to the one displayed in FIG. 5 to perform the drawdown the underground well 24. The output of the compression pump 10 may be towards either the tubing connection valve 52 which links to the fluid contained within the underground production tubing 49, or may be towards the casing annulus connection valve 51 which links the fluid contained within the casing annulus 48. To kill the well, after performing the steps described in FIG. 5, the compression pump 10 may pump the kill fluid present within the water reservoir 69, first towards the casing annulus connection valve 51, and then towards the tubing connection valve 52. The underground well 24 may be considered 'killed' when sufficient kill fluid has been pumped, and when sequentially the pressure of the casing annulus 48 has reached 0 psi [0 MPa] and the pressure of the underground production tubing 49 has reached 0 psi [MPa].

Figure 7:
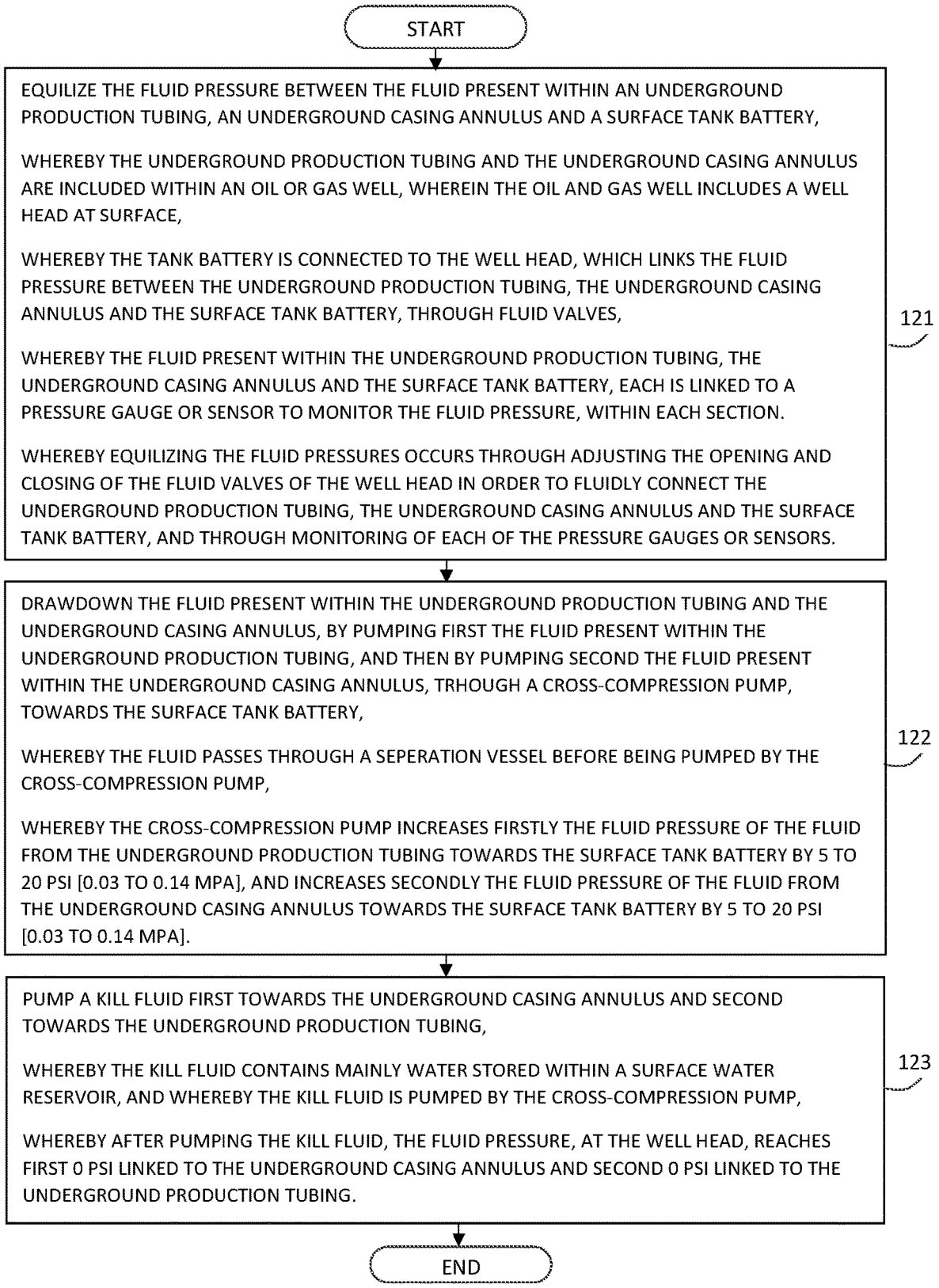
FIG. 7 represents a detailed method flowchart including the major steps of the invention linked to FIG. 5 and FIG. 6.

FIG. 7 depicts a flowchart sequence method, related to the flow schematic described in FIG. 5 and FIG. 6.

A first step 121, with starting the sequence method, includes equalizing the fluid pressure between the fluid present within the underground production tubing 49, the casing annulus 48 and the surface tank battery 47. The underground production tubing 49 and the casing annulus 48 are included within an underground oil or gas well 24, wherein the underground well 24 includes a well head 21 at surface. The surface tank battery 47 is connected to the well head 21, which links the fluid pressure between underground production tubing 49, the casing annulus 48 and the surface tank battery 47, through fluid valves 51 and 52. The fluid present within the underground production tubing 49, the casing annulus 48 and the surface tank battery 47 is linked to individual pressure gauges or sensors, 60, 59, 55, 56, in order to monitor the fluid pressure within each flow line connection. The pressure equalization occurs through adjusting the opening and closing the fluid valves present within and around the well head 21, namely using valves 51, 52, 81, 82, 83.

A second step 122 may include the drawdown of the fluid present within the underground production tubing 49 and the casing annulus 48, by firstly pumping the fluid present within the underground production tubing 49, and secondly by pumping the fluid present within the casing annulus 48, through the compression pump 10, towards the surface tank battery 47. The fluid may pass through the separation vessel 64 to separate the fluid from solids phase or heavy liquid phase. The compression pump 10 may increase firstly the fluid pressure of the fluid from the underground production tubing 49 towards the surface tank battery 47, by 5 to 20 psi [0.03 MPa to 0.14 MPa]. The compression pump 10 may increase secondly the fluid pressure of the fluid from the casing annulus 48 towards the surface tank battery 47, by 5 to 20 psi [0.03 MPa to 0.14 MPa].

A third step 123 may include the pumping of a fill fluid. The kill fluid may be stored with a surface water reservoir 68 using the compression pump 10. The pumping of the kill fluid may be pumped firstly towards the casing annulus 48, and secondly towards the underground production tubing 49. After pumping the kill fluid, the fluid pressure, at the well head 21, may reach firstly 0 psi [0 MPa] for the fluid linked to the casing annulus 48, and may reach secondly 0 psi [MPa] for the fluid linked to the underground production tubing 49.

What is claimed is:

1. A method of unloading a fluid mixture from underground production tubing comprising:

pulling, via a compression pump provided downstream of a well head, the fluid mixture from a vertical section of the underground tubing such that a hydrostatic pressure of the fluid mixture within the underground production tubing is reduced, wherein the fluid mixture comprises a gas phase, a liquid phase, and a solid phase;

flowing the fluid mixture into a separation vessel to separate the gas phase, the liquid phase, and the solid phase;

flowing, via the compression pump, the gas phase and the liquid phase into a tank battery to be stored for future use, such that no portion of the gas phase or the liquid phase is vented to the atmosphere; and continuing to pull the fluid mixture from the vertical section of the underground tubing until the reduction in hydrostatic pressure of the fluid mixture inside the underground production tubing is sufficient to re-establish a production flow out of the underground production tubing, wherein the production flow had previously been limited.

2. The method of claim 1, wherein the underground production tubing is surrounded by an underground casing, such that a casing annulus is defined between the underground production tubing and the underground casing, the method further comprising:

injecting, via a secondary compression pump provided downstream of the well head, a surface gas phase towards the casing annulus, wherein the surface gas phase is stored inside a gas source.

3. The method of claim 2, wherein the underground production tubing includes a plunger lift and gas lift valves, and wherein the plunger lift or the gas lift valves are used to unload the fluid mixture present within the underground production tubing.

4. A method of killing an oil or gas well that includes a fluid mixture present within an underground production tubing and present within an underground casing annulus, the method comprising:

coupling the underground production tubing and the underground casing annulus with a surface tank battery via a well head of the oil or gas well, wherein the well head includes fluid valve connections linking the underground production tubing, the underground casing annulus and the surface tank battery;

equalizing a fluid pressure of the fluid mixture present within the underground production tubing and present within the underground casing annulus, with a fluid pressure of the fluid mixture present within the surface tank battery by adjusting positions of the fluid valve connections;

pumping, via a cross-compression pump provided downstream of the well head, the fluid mixture present within the underground production tubing and the fluid mixture present within the underground casing annulus towards the surface tank battery; and pumping, via the cross-compression pump, a kill fluid towards the underground casing annulus, and towards the underground production tubing, wherein pressure gauges or sensors are provided to monitor the fluid pressure in the underground production tubing, the underground casing annulus, and the surface tank battery.

5. The method of claim 4, wherein during a fluid mixture drawdown, the cross-compression pump is first configured to increase the fluid pressure of the fluid mixture present within the underground production tubing by a range of 5 psi to 20 psi [0.02 MPa to 0.14 MPa] before pumping the fluid mixture towards the surface tank battery; and the cross-compression pump is second configured to increase the fluid pressure of the fluid mixture present within the underground casing annulus by a range of 5 psi to 20 psi [0.02 MPa to 0.14 MPa] before pumping the fluid mixture towards the surface tank battery.

6. The method of claim 5, wherein the kill fluid contains mainly water, stored within a surface water reservoir.

7. The method of claim 6, wherein the kill fluid is first pumped into the underground casing annulus until the fluid pressure of the fluid mixture present within the underground casing annulus reaches 0 psi [0 MPa], and the kill fluid is second pumped into the underground production tubing until the fluid pressure of the fluid mixture present within the underground production tubing reaches 0 psi [0 MPa].

8. A system comprising:

a compression pump configured to pull a fluid mixture from a vertical section of underground tubing, via a well head, such that a hydrostatic pressure of the fluid mixture within the underground production tubing is reduced, wherein the fluid mixture comprises a gas phase, a liquid phase, and a solid phase;

a separation vessel configured to receive the fluid mixture from the vertical section of underground tubing and separate the gas phase, the liquid phase, and the solid phase; and a tank battery configured to receive and store the gas phase and the liquid phase of the fluid mixture for future use, wherein the gas phase and the liquid phase of the fluid mixture are conveyed from the separator to the tank battery by the compression pump such that no portion of the gas phase or the liquid phase is vented to the atmosphere.

9. The system of claim 8, wherein the reduction in hydrostatic pressure of the fluid mixture inside the underground production tubing is sufficient to re-establish a production flow out of the underground production tubing.

10. The system of claim 8, wherein the underground production tubing is surrounded by an underground casing, such that a casing annulus is defined between the underground production tubing and the underground casing, the system further comprising:

a gas source containing a surface gas phase; and a secondary compression pump configured to inject the surface gas phase towards the casing annulus, via the well head.

11. The system of claim 10, wherein the casing annulus includes a packer configured to isolate the underground production tubing and the casing.

12. The system of claim 10, further comprising gas lift valves, wherein the surface gas phase is configured to be injected into the gas lift valves to aid in pulling the fluid mixture from the vertical section of underground tubing.

13. The system of claim 8, further comprising a plunger lift configured to aid in pulling the fluid mixture from the vertical section of underground tubing.

* * * * *